United States Patent [19]

Longley, Jr.

[11] Patent Number: 4,794,906

[45] Date of Patent: Jan. 3, 1989

[54] PORTABLE, COLLAPSIBLE FIELD STOVE

[76] Inventor: James B. Longley, Jr., 48 Robinson Garden, Lewiston, Me. 04240

[21] Appl. No.: 84,820

[22] Filed: Aug. 13, 1987

[51] Int. Cl.[4] ..... F24C 1/16

[52] U.S. Cl. ..... 126/9 R; 126/9 B; 126/38; 126/43

[58] Field of Search ..... 126/9 R, 9 B, 25 R, 126/38, 29, 30, 43

[56] References Cited

U.S. PATENT DOCUMENTS

| | | | |
|---|---|---|---|
| 1,212,162 | 1/1917 | Green | 126/9 B |
| 1,404,808 | 1/1922 | Taylor | 126/38 X |
| 2,424,665 | 7/1947 | Pope | 126/9 R |
| 2,469,885 | 5/1949 | Mella | 126/9 B |
| 3,146,773 | 9/1964 | Melzer | 126/9 R |
| 3,698,376 | 10/1972 | Webb | 126/9 R |
| 3,892,222 | 7/1975 | Darbo | 126/9 R |
| 4,126,116 | 11/1978 | McCallum | 126/9 R |
| 4,149,514 | 4/1979 | Latouf | 126/9 R |
| 4,455,992 | 6/1984 | Hsiao | 126/9 R |
| 4,532,910 | 8/1985 | Longley | 126/9 B |

FOREIGN PATENT DOCUMENTS

| | | | |
|---|---|---|---|
| 23041 | of 1915 | United Kingdom | 126/9 R |

*Primary Examiner*—Margaret A. Focarino
*Attorney, Agent, or Firm*—T. M Gernstein

[57] ABSTRACT

A portable field stove is adapted to assume a collapsed configuration for storage and a set-up configuration for supporting a utensil above a portable heat source. The stove includes self-locking features that wedge a bottom plate against a shoulder and against a front plate to lock the stove into the set-up configuration. The stove also includes cutouts, openings and holes which are arranged and configured to permit only the proper amount of air to flow into the stove and to direct that air so that it does not flow across the heat source. The cutouts, openings and holes are also arranged to establish an air flow pattern through the stove that efficiently uses the heat generated by the heat source. The stove can also be used in an inverted orientation.

11 Claims, 1 Drawing Sheet

PORTABLE, COLLAPSIBLE FIELD STOVE

BACKGROUND

The present invention relates, in general, to cooking equipment, and more particularly, to portable field stoves.

Heating and cooking food and heating fluids in the field has always presented problems to campers and hikers. These people have only limited space and weight which can be devoted to their cooking needs, yet such needs are essential and may be critical if the person is subject to severe environmental conditions and has a possibility of being cut off from supplies or from support areas. These problems must be solved, yet cannot be solved using equipment which is unduly expensive or which creates problems or inefficiencies in the field.

Heating and cooking devices for use by campers, or the like, should be easily transported in a form which does not require a great deal of space and which is not unduly heavy. Yet, at the same time, these devices should be sturdy even in severe weather and terrain conditions, as a stove or grill collapsing can be dangerous. These requirements are made even more difficult by a further requirement that such devices be easily and quickly assembled and disassembled in the field so that camp set-up and break-up can be efficiently and conveniently carried out by all, even those whose dexterity is impaired for some reason, such as because they are wearing heavy gloves, or the like.

Cost is a further consideration for these devices. Thus, while satisfying all of the above requirements, a successful device of this type should not be difficult or costly to manufacture or be unduly expensive to the consumer. Furthermore, if there are a multiplicity of parts, or if the parts of a device are easily lost but not easily replaced, or if an entirely new unit is required if one element of a stove is damaged or lost, the stoves are expensive.

Along this line, to be most cost-effective, the stove should be amenable to as many different uses as possible. For example, many of the presently-available stoves can be used for heating foods, while many other types of presently-available stoves can be used to fry foods, while other such stoves can be used to heat liquids. However, none of the presently-available stoves are amenable to efficiently accomplishing all of these tasks without requiring additional equipment and while still satisfying all of the above-stated criteria.

Efficient use of heat source fuel is another important consideration to field stoves. If fuel is burned too quickly, fuel costs are high, yet if fuel is burned too quickly, fuel costs are high, yet if fuel is burned too slowly, cooking time is too long. If fuel cannot be readily replenished, it becomes very important to properly ventilate the stove for the most efficient fuel consumption.

Another important consideration for such equipment is adaptability for use under a variety of environmental conditions. Thus, a person may camp in mountainous terrain, in windy areas, or even on snow or ice-covered terrain such as Arctic environments. It is desirable to have one single device which can function reliably and efficiently under all of these conditions.

Because military personnel are often cut off from sources of supply, all of the above-mentioned requirements are present and elevated from mere requirements to critical needs for military personnel. Also, since the military may require millions of field stoves, the cost of each item is an extremely important consideration. Furthermore, military personnel must be highly mobile and able to make camp and break camp quickly. In addition to the above requirements, the change from canned rations to dried rations in both civilian and military areas has created new problems. In the past, a canteen cup, such as used by the military, could be used as a container in which to heat fluids or rations. While convenient and effective, the canteen cup still must be placed over a heat source to effect this heating.

With canned rations, certain foods, such as crackers, for example, were stored in cans. Once opened, these cans provided a convenient field stove in which a portable heat source could be placed to heat a canteen cup or other food storage can resting on top of the can. Furthermore, food in such rations was often stored in fluid and thus could be heated or cooked in a convenient manner over such a temporary field "stove".

This system of forming field stoves worked well until the rations system in both the civilian and the military areas was converted from cans to ready-to-eat freeze dried and pouched foods. This conversion realizes many advantages over the canned feed ration system, but also creates several problems for the person in the field. First, the use of dried and pouched foods creates a requirement for additional water to replace the fluid heretofore present in the canned foods, such fluid being both a cooking medium and a consumable fluid. Second, the removal of the can itself eliminated the herein above-discussed heat source container used in conjunction with a canteen cup to form a portable field stove.

OBJECTS

It is a main object of the present invention to provide a novel and improved portable, collapsible field stove which is usable in a wide variety of weather and terrain conditions. which is effective and which uses fuel in an efficient manner.

It is another object of the present invention to provide a novel and improved collapsible field stove which can be formed using a minimum number of parts to be light-weight and unitary and easily set up.

It is another object of the present invention to provide a field stove that is easily carried in a shirt pocket or the like, and is essentially noiseless in a collapsed condition when being thus transported.

It is another object of the present invention to provide a field stove that is adjustable and adaptable for uses with a plurality of different utensils and fuel sources and is amenable to a wide variety of cooking needs without requiring extra equipment.

It is another object of the present invention to provide a field stove that is inexpensive and easy to manufacture so it can be disposable if desired.

It is another object of the present invention to provide a field stove which is amenable to military use.

It is another object of the present invention to provide a field stove which is sturdy and stable in the set-up configuration even in a variety of orientations.

SUMMARY OF THE INVENTION

These and other objects are accomplished by the present invention which is embodied in a portable, field stove which is adapted to assume a collapsed configuration for easy storage, yet in a set-up configuration is quite sturdy and supports cooking utensils in a stable manner. The field stove is amenable to a wide variety of uses, yet consumes a heat source in an efficient manner.

The field stove is unitary and includes a self-locking feature so that when it is set up, the stove is quite stable even in a variety of positions and orientations. The stove further includes air flow control means which ventilates a fuel source contained in the stove but does not permit a cross circulation of air in the vicinity of the fuel source whereby fuel source burning is efficient without being too fast.

DETAILED DESCRIPTION

Figure 1:
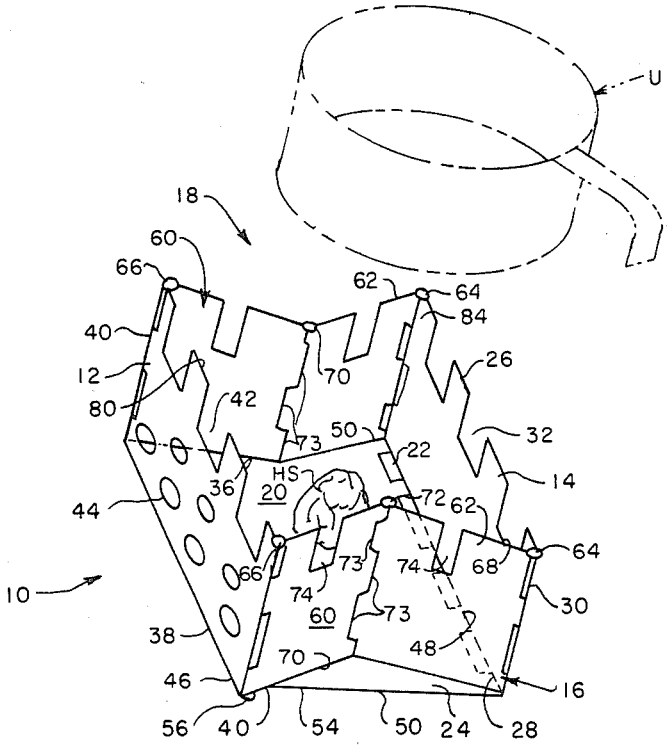
FIG. 1 is a perspective of the field stove embodying the present invention in the set-up configuration.

Shown in the figures is a portable stove 10 that is collapsible into a storable configuration, and that is adapted to support a cooking utensil U over a portable heat source HS.

The stove 10 is self-locking in the set-up configuration, that is, in the set-up configuration, the stove has means for locking its various elements into position. In this manner, the stove 10 will be extremely stable and capable of securely supporting heavily loaded utensils. Thus, the stove includes a front plate 12 and a back plate 14 collapsably connected together by foldable end means 16 and 18. A bottom plate 20 is pivotable connected to the back plate 14 by pivot means, such as hinge means 22, and is adapted to support on the top surface 24 thereof the heat source HS. The hinge 22 includes openings which are sized according to considerations that will be discussed below, It is noted that terms such as "front", "back" and "bottom" are terms of convenience and are not intended to be limiting.

As shown in FIG. 1, the back plate 14 includes a top edge 26, a bottom edge 28 and end edges 30. A plurality of rectangular cutouts 32 are defined in the back plate 14 to extend from the top edge 26 toward the bottom edge 28. The cutouts have length dimensions and width dimensions that give them an area that is selected according to specific requirements as set forth below. It is also noted that, except for the cutouts 32 and the openings of the hinge 22, the back plate 14 is impervious to air.

The front plate 12 has a top edge 36, a bottom edge 38 and side edges 40. As is the case with the back plate, the front plate includes a plurality of rectangular cutouts 42 spaced apart from each other along the length of the plate, and each of these rectangular cutouts has a length dimension and a width dimension selected to provide a specified area for the cutouts.

In addition to the cutouts 42, the front plate also includes a plurality of holes 44 located adjacent to, but spaced from, the front plate bottom edge 38. The holes are spaced apart from each other and are arranged to two rows. The holes are sized and located according to principles and requirements which will be discussed below.

The bottom plate 20 is rectangular and includes a front edge 46 and a rear edge 48 which are connected together by side edges 50. The bottom plate includes top surface 24 on which the heat source HS is supported, and a bottom surface 54 which will be exposed to the supporting means, such as the ground or the like, when the stove is set up in the upright orientation shown in FIG. 1. The bottom plate is impervious to air except for the openings associated with the hinge 22 so that the air flowing through such hinge-adjacent openings is the only air permitted to pass into the set-up stove via the bottom thereof.

The front plate 12 includes a ledge-forming shoulder 56 along the bottom edge 38 thereof. This shoulder 56 is positioned on the front plate to be located inside the set-up stove, and the bottom plate 20 is sized to rest on the shoulder 56 in such set-up configuration. The shoulder 56 is preferably formed by rolling the bottom edge of the front plate inwardly of the set-up stove into an elongate tube which extends for essentially the entire length of the front plate.

The end means 16 and 18 are identical, and each includes a pair of end plates 60 and 62 each foldably attached to a respective one of the front and back plate end edges 40 and 30 by hinges64 and 66 respectively to be adapted to fold inwardly of a set-up stove toward the respective front and back plate as shown in FIG. 1. Each of the end plates includes a top edge and a bottom edge which are essentially coplanar to form an end means top edge 68 and an end means bottom edge 70. Each of the end means end plates is foldably connected to an adjacent end plate by a hinge 72 so the end means can be folded into the set-up stove as shown in FIG. 1. Each of the hinges 72 includes openings 73 which are also sized according to considerations which will be discussed below.

The hinges 64 and 66 are positioned on the front and rear plates to be located inside the set-up stove, and the end plates are sized so that when the bottom plate 20 is received between the front and rear plates, the end means is folded inwardly as shown in FIG. 1. The end plates 60 and 62 also include second cutouts 74 which are rectangular and extend from the end plate top edge. The second cutouts 74 have a length and a width dimension which sizes these second cutouts to be smaller than the first cutouts.

As shown in FIG. 1, in the set-up configuration of stove 10, the bottom plate 20 extends from back plate 14 to front plate 12 and the front edge of the bottom plate bears against inside surface 80 of the front plate while the bottom surface 54 of the bottom plate bears against the shoulder 56. The end plates 60 and 62 of the end means are folded to the FIG. 1 position so the end means bottom edge 70 bears against the bottom plate to surface 52 thereby wedging the bottom plate between the end means, the front plate inside surface 80 and the shoulder 56. This edging action securely locks the bottom plate in position and thus securely locks the stove into the set-up configuration. It is also noted that when a utensil is supported on the top of the stove, the weight of such utensil forces the end means downwardly thereby increasing the above-mentioned wedging action and increasing the security of the self-locking feature of the stove.

Figure 2:
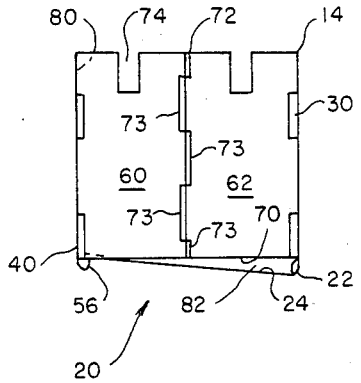
FIG. 2 is an end elevation of the stove embodying the present invention in the set-up configuration.

As best shown in FIG. 2, the air control means also includes a pair of triangular openings 82 defined by the tilted bottom plate and the coplanar bottom edge 70 of the end means. These triangular openings 82 extend from the hinge 22 to a location spaced from the shoulder 56 and have the major portion thereof located adjacent to the hinge 22. In this manner, most of the air flowing into the set-up stove via the openings 82 will encounter the back plate 14 and the end plate 62. Since the end plates 62 are angled inwardly of the set-up stove, the air entering via openings 82 will be guided by a triangular channel 84, which is best shown in FIG. 1. This channel is located adjacent to the back plate 14 and will tend to direct the air flowing therein along the back plate and not across the heat source HS. However, since the channels 84 are open, the air will serve to aerate the heat source, and thus will serve to control the burning of that heat source; however, this air flowing in the channels 84 will not flow so as to establish a cross-ventilation of the heat source. Therefore, aeration without significant cross flow will be established via the openings 82 and the channels 84.

The cutouts 32, 42, 74; the holes 44; the openings 82 and the openings associated with the hinges are sized to control the air flow into the set-up stove so the fuel source HS burns rapidly enough to produce sufficient heat yet not so rapidly as to be too rapidly consumed. The cutouts, holes and openings are sized, configured and positioned to also control the flow of heated air to effect the most efficient heating of a utensil supported on the stove.

To accomplish these purposes, the cutouts, openings and holes are designed and positioned to permit only a predetermined amount of air to flow into the stove in predetermined directions, to prevent air flowing across the heat source, and to efficiently guide heated air to the top of the stove. It is observed that a flow of air across the heat source tends to cause that source to burn too quickly and to also carry heat directly out of the stove without carrying it upwards toward the utensil. Such cross flow of air is thus doubly wasteful of heat source. Thus, the air impervious nature of the back plate, the angled orientation of the end plates, the location of the openings and holes all cooperate to prevent such cross flow by providing barriers that cause the preselected amounts of air flowing into the stove to encounter air impervious barriers and to be directed upwardly toward the utensil being heated.

The above-discussed relative sizing of the cutouts, openings and holes is accomplished in the FIG. 1 embodiment by having the cutouts 32 larger than the cutouts 74 and the openings associated with hinge 22 larger than the openings associated with hinge 72, and holes 44 larger in area than the openings associated with the hinges, but smaller in size than the cutouts. Two rows of holes 44 are provided and are located so the bottoms of the holes are spaced above the top of the heat source. The triangular openings 82 have an area which is smaller than that of the cutouts. However, other sizings, placements and orientations can be used as will occur to one skilled in the art based on the teaching of this disclosure.

Examples of the above dimensions are: Cutouts 32 and 42: 1.3 mm wide by 1.1 mm high; cutouts 74: 0.5 mm wide by 1.1 mm high; holes 44: 0.65 mm in diameter; opening 82: 4.6 mm long by 0.5 mm high; openings adjacent to hinges 30: 0.3 mm wide by 1.4 mm long; openings adjacent to hinges 40: 0.2 mm wide by 1.4 mm long; the openings adjacent to hinges 72: 0.1 mm by 1.0 mm; and openings adjacent to hinge 22: 0.1 mm wide by 1.2 mm long. The bottom plate 20 is 5.6 mm by 7.7 mm, and the holes 44 are located 0.7 mm above the bottom and 2.2 mm below the bottom of cutouts 42. The end plates 60 and 62 define an angle of about 20 degrees with the adjacent plate, and the stove collapses into a package that is 8.6 mm by 0.8 mm by 5.7 mm. and forms a cubical shape in the set-up configuration having dimensions of 5.7 mm by 5.7 mm by 5.7 mm.

In this manner, the amount and direction of air flow to and from the stove 10 is carefully controlled to produce efficient burning of the heat source and efficient utilization of the heat produced thereby. The holes and openings adjacent to the bottom of the stove are arranged to conduct proper amounts of air into the stove and to redirect that air upwardly and not across the heat source, while the cutouts at the top of the stove direct that heated air across the utensil in the most effective manner.

Figure 3:
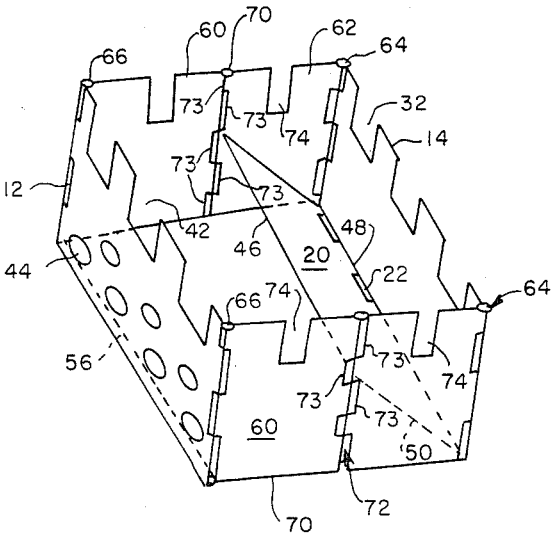
FIG. 3 is a perspective of the field stove embodying the present invention in the partially collapsed configuration.
Figure 4:
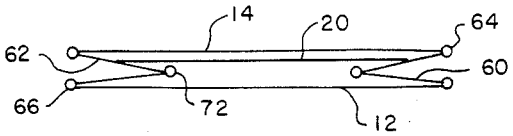
FIG. 4 is a top view of the stove of the present invention in the collapsed configuration.

The stove is easily collapsed as indicated in FIGS. 3 and 4 by simply moving the end means from the folded position and toward a planar configuration to release the wedging of the bottom plate, and rotating the bottom plate upwardly toward the back plate until it is positioned adjacent thereto. After the bottom plate is thus positioned, the end means are folded about the hinges 70 to collapse the stove into the FIG. 4 configuration. The collapsed stove is smaller than a pack of cigarettes and fits easily into a shirt pocket, or the like. Since the stove is unitary, its parts will not become separated and subject to being lost, and will be quiet when carried in the collapsed configuration.

Figure 5:
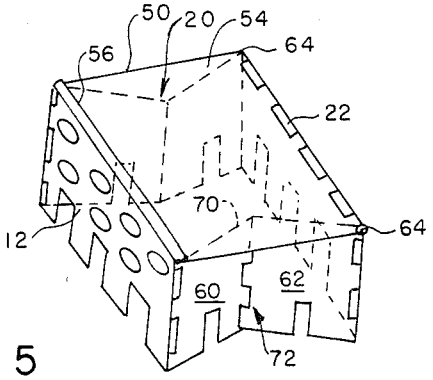
FIG. 5 is a perspective of the stove of the present invention in the set-up configuration and inverted from the FIG. 1 orientation.

As an alternative, the set-up stove 10 can be inverted from the FIG. 1 orientation to place the bottom surface 54 of the bottom plate 20 on top as shown in FIG. 5. In this inverted orientation, the stove can be used to fry food placed on the bottom plate. It is noted that the inverted stove will not work as efficiently as the upright stove, but does add versatility to the stove. The self-locking feature of the end means will support the bottom plate in the FIG. 5 position.

The above disclosure is intended to provide those skilled in the art enough teaching so that they can understand what is included in the present invention. However, no limitation is intended, and any embodiment, modification or the like that comes within the scope of the appended claims is intended to be encompassed and covered by this invention.

I claim:

1. A portable field stove which is adapted to assume a collapsed configuration for storage and a set-up configuration for supporting a cooking utensil above a portable heat source comprising:

a front plate and a back plate each having a top edge, a bottom edge and end edges, and a ledge-forming shoulder on the bottom edge of said front plate;

a bottom plate having a top surface and a bottom surface and being pivotably attached to said back plate by a pivot means to pivot toward said back plate to collapse the stove and to pivot toward said front plate to set up the stove, said bottom plate being sized and adapted to abut said front plate and said ledge-forming shoulder in the set-up configuration of the stove;

end means having top and bottom edges and end edges with said end means end edges being pivotally connected to said front and back plates by pivot means, each of said end means further including hinge means located between said end means end edges, said end means being adapted to bend at said hinge means inwardly of the stove when the stove is set up and being sized to position said end means bottom edges adjacent to and above the top surface of said bottom plate for wedging said bottom plate between said end means and said ledge-forming shoulder to securely lock the stove in the set-up configuration; and air flow control means in said plates and in said end means including first cutouts in said front and back plates located to extend from said front and back plate top edges, second cutouts in said end means located to extend from top edges of said end means, holes in said front plate located adjacent to said ledge-forming shoulder, first openings between said bottom plate and said end means and second openings adjacent to said attachments between said end means and said front and back plates and between said back plate and said bottom plate and adjacent to said end means hinge means, said holes and openings being sized and arranged to cooperate to draw air into the stove.

2. The portable field stove defined in claim 1 defined wherein said back plate is impervious to air in all locations other than said first cutouts and the openings.

3. The portable field stove defined in claim 2 wherein said first cutouts are larger than said second cutouts.

4. The portable field stove defined in claim 3 wherein said end means openings are smaller than the openings adjacent to the attachments between said end means and said front and back plates.

5. The portable field stove defined in claim 2 wherein said bottom plate is attached to said back plate bottom edge and said ledge-forming shoulder is spaced from said front plate bottom edge so that said bottom late tilts upwardly from said back plate bottom edge when the stove is in the set-up configuration.

6. The portable field stove defined in claim 5 wherein each of the first openings has a size which decreases from the size thereof adjacent to said back plate.

7. The portable field stove defined in claim 1 further including end hinges for pivotably connecting said end means to said front and back plates, each of said end hinges being positioned to be located inside the stove when the stove is in the set-up configuration.

8. The portable field stove defined in claim 7 wherein said end means hinges are positioned to be located outside of the stove when the stove is in the set-up configuration.

9. A portable field stove which is adapted to assume a collapsed configuration for storage and a set-up configuration for supporting a cooking utensil above a portable heat source comprising:

a front plate and a back plate each having a top edge, a bottom edge and end edges, and a ledge-forming shoulder on the bottom edge of said front plate;

a bottom plate having a top surface and a bottom surface and being pivotably attached to said back plate by a pivot means to pivot toward said back plate to collapse the stove and to pivot toward said front plate to set up the stove, said bottom plate being sized and adapted to abut said front plate and said ledge-forming shoulder in the set-up configuration of the stove;

end means having top and bottom edges and end edges with said end means end edges being pivotally connected to said front and back plates by pivot means, each of said end means further including hinge means located between said end means end edges, said end means being adapted to bend at said hinge means inwardly of the stove when the stove is set up and being sized to position said end means bottom edges adjacent to the top surface of said bottom late for wedging said bottom late between said end means and said ledge-forming shoulder to securely lock the stove in the set-up configuration; and air flow control means in said plates and in said end means for drawing air into the stove.

10. A portable field stove which is adapted to assume a collapsed configuration for storage and a set-up configuration for supporting a cooking utensil above a portable heat source comprising:

a front plate and a back plate and collapsible end means connecting said front and said back plates together, said front plate having a shoulder thereon;

a bottom plate having a top surface and being pivotally attached to said back plate by a pivot means and being adapted to contact said front plate shoulder, said end means including bottom means and hinge means and being sized and adapted to move about said hinge means to orient said bottom means to abut the bottom plate top surface to hold said bottom plate against said front plate shoulder in the set-up configuration of the stove; and air flow control means in said plates and in said end means for drawing air into the stove.

11. A portable field stove which is adapted to assume a collapsed configuration for storage and a set-up configuration for supporting a cooking utensil above a portable heat source comprising:

a front plate having a ledge thereon and a back plate and collapsible end means connecting said front and said back plates together;

a bottom plate having a top surface and being pivotally attached to said back plate by pivot means and being sized and adapted to contact said front plate ledge, said end means including bottom means and hinge means and being sized and adapted to move about said hinge means to orient said bottom means in abutting relation with the bottom plate top surface to form a wedge which abuts the bottom late top surface in the set-up configuration of the stove to hold said bottom plate against said front plate ledge; and air flow control means in said plates and in said end means for drawing air into the stove.

* * * * *